US005752302A

United States Patent [19]

Sheen et al.

[11] Patent Number: 5,752,302

[45] Date of Patent: May 19, 1998

[54] METHOD AND APPARATUS FOR SIZING AND SEPARATING WARP YARNS USING ACOUSTICAL ENERGY

[75] Inventors: Shuh-Haw Sheen; Hual-Te Chien, both of Naperville; Apostolos C. Raptis, Downers Grove; David S. Kupperman, Oak Park, all of Ill.

[73] Assignee: The United States of America as represented by the United States Department of Energy, Washington, D.C.

[21] Appl. No.: 838,955

[22] Filed: Apr. 23, 1997

[51] Int. Cl.[6] ..... D02H 5/02

[52] U.S. Cl. ..... 28/181; 8/151.2; 68/355; 427/394

[58] Field of Search ..... 8/151.2; 68/355; 28/178, 181; 427/394

[56] References Cited

U.S. PATENT DOCUMENTS

| | | | |
|---|---|---|---|
| 4,025,993 | 5/1977 | Kuroda . | |
| 4,482,605 | 11/1984 | Cutts . | |
| 4,513,485 | 4/1985 | Cutts | 28/181 |
| 4,526,808 | 7/1985 | Strohmaier | 68/3 SS |
| 4,773,136 | 9/1988 | Seydel et al. . | |
| 4,793,035 | 12/1988 | Nehrenberg et al. . | |
| 4,794,679 | 1/1989 | Hiraki . | |
| 4,913,861 | 4/1990 | Mishima et al. . | |
| 5,016,451 | 5/1991 | Tsukabayashi et al. . | |
| 5,027,485 | 7/1991 | Hager et al. . | |
| 5,133,376 | 7/1992 | Samarin et al. | 68/3 SS |
| 5,193,362 | 3/1993 | Otto | 68/3 SS |
| 5,203,362 | 4/1993 | Shibata | 68/3 SS |
| 5,511,395 | 4/1996 | Hamade et al. . | |

*Primary Examiner*—Andy Falik

*Attorney, Agent, or Firm*—Lisa M. Soltis; Mark P. Dvorscak; William R. Moser

[57] ABSTRACT

A slashing process for preparing warp yarns for weaving operations including the steps of sizing and/or desizing the yarns in an acoustic resonance box and separating the yarns with a leasing apparatus comprised of a set of acoustically agitated lease rods. The sizing step includes immersing the yarns in a size solution contained in an acoustic resonance box. Acoustic transducers are positioned against the exterior of the box for generating an acoustic pressure field within the size solution. Ultrasonic waves that result from the acoustic pressure field continuously agitate the size solution to effect greater mixing and more uniform application and penetration of the size onto the yarns. The sized yarns are then separated by passing the warp yarns over and under lease rods. Electroacoustic transducers generate acoustic waves along the longitudinal axis of the lease rods, creating a shearing motion on the surface of the rods for splitting the yarns.

9 Claims, 2 Drawing Sheets

METHOD AND APPARATUS FOR SIZING AND SEPARATING WARP YARNS USING ACOUSTICAL ENERGY

CONTRACTUAL ORIGIN OF THE INVENTION

The United States Government has rights in this invention pursuant to Contract Number W-31-109-ENG-38 between the United States Government and Argonne National Laboratory.

BACKGROUND OF INVENTION

1. Field of Invention

The present invention relates to a method and apparatus for preparing warp yarns for weaving operations, and particularly to a slashing process which includes the steps of sizing and/or desizing the yarns in an acoustic resonance box and separating the yarns in a leasing apparatus comprised of a set of acoustically agitated lease rods.

2. Description of the Prior Art

In preparation for the weaving of threads by a loom, warp yarns, which are those threads which run lengthwise in a woven fabric, are subjected to a slashing process, wherein the warp yarns are drawn through a size solution, dried, and separated. The size solution is a protective coating which is applied to the warp yarns to promote better processing of the yarns in the subsequent weaving operation. The size solution holds the threads together, weights the threads, and prevents the threads from being chafed and broken by the loom. Size solution typically consists of size chemicals, such as starch or PVA (polyvinyl alcohol), dispersed in water and may also include other additives which are well known in the art.

The size solution is applied to the warp yarns by a slasher apparatus. A slasher typically comprises a size box containing the size solution and a set of rollers for guiding the warp yarns through the size solution. In a conventional system, the yarns pass under an immersion roller, immersing the yarns in the size solution, and then between a pair of pressure rollers which presses the size solution into the yarns and removes some of the excess water of the size solution from the yarns. The slashing process may further include a desizing step in which the size chemicals are removed from the yarns. In a desizing process, the desizing agent replaces the size solution in the size box.

After the size solution is applied to the warp yarns, the sized yarns are subjected to a drying process. Conventionally, yarns are dried by passing them through hot air and/or over heated rollers or cans which evaporate most of the water. The energy required to dry the yarns is a function of the water content of the size solution and the process by which the size solution is applied to the yarns. The drying process causes adjacent ends or strands to stick together due to excess size solution. Thus, the drying process bonds the warp yarns together.

A leasing apparatus splits the dried yarns and separates the adjacent ends for subsequent feeding into a weaving machine. Generally, a leasing apparatus includes lease rods or separator bars. The bonds between the warp yarns created by the drying process are broken by passing the warp sheets over and/or under lease rods and/or combs.

One problem associated with the conventional slashing process is the high amount of energy required to dry the sized yarns and the corresponding operational cost. A second problem is damage caused to the yarns by the leasing apparatus, which, as discussed above, tears or busts the warp yarns apart, often resulting in broken or weakened yarns and negatively effecting the quality of the size coating.

To reduce the amount of energy required to dry the sized yarns, several prior art solutions have focused on using a highly concentrated size solution. However, a size solution of high concentration also has a high viscosity which impairs the effectiveness of the pressure rollers to press the size solution into the yarns and results in the formation of an excess sizing layer on the surface of the yarns. The excess sizing layer further hinders the drying process as the sizing collects on rollers and creates an uneven coating on the yarns.

Another prior art solution is to meter the amount of size solution applied to the yarns. For example, the amount of size solution applied to the yarns may be limited by configuring the pressure rollers such that only the bottom roller is partially immersed in the size solution and advances against a blade to remove excess size solution prior to coating the yarns. Other prior art solutions include increasing the pressure of the pressure rollers, squeezing the yarns at least twice, or applying the size solution to only one side of the warp yarns, whereby the water content in the sized yarn becomes less and the yarns can be dried more rapidly resulting in the consumption of heat energy being reduced.

There exists a significant and continuing demand for a slashing process which requires less energy at a reduced cost while providing effectively sized and separated yarns for introduction into the weaving operation.

Therefore, in view of the above, a basic object of the present invention is to provide a method for slashing warp yarns which results in a reduction in water usage, energy, and thus, cost.

Another object of this invention is to provide a method for slashing warp yarns which uses an improved size box, namely, an acoustic resonance box. The acoustic resonance box contains the size solution and includes an array of acoustic transducers in contact with the exterior of the box for generating an acoustic pressure field within the size solution. The acoustic resonance box allows highly concentrated size solutions to be used, by effectively and continuously agitating the size solution for uniform application and penetration of the size onto the warp yarns.

Yet another object of the invention is to provide a method for separating adjacent warp yarns by passing the yarns over and/or under lease rods which apply a shearing motion to the yarns at an ultrasonic frequency.

Additional objects, advantages and novel features of the invention will be set forth in part in the description which follows, and in part will become apparent to those skilled in the art upon examination of the following or may be learned by practice of the invention. The objects and advantages of the invention may be realized and attained by means of instrumentation and combinations particularly pointed out in the appended claims.

BRIEF SUMMARY OF THE INVENTION

The present invention relates to a method and apparatus for preparing warp yarns for weaving operations, and particularly to a slashing process which includes the steps of sizing and/or desizing the yarns in an acoustic resonance box and separating the yarns in a leasing apparatus comprised of a set of acoustically agitated lease rods.

Briefly, the sizing step includes guiding the yarns by conventional rollers through an acoustic resonance box which contains a size solution. An acoustic pressure field is generated within the size solution by positioning one or more acoustic transducers against the exterior of the box. Ultrasonic waves resulting from the acoustic pressure field continuously agitate the size solution to effect greater mixing and more uniform application and penetration of the size solution onto the yarns. Thus, less excess size solution resides on the surface of the yarns, and a higher viscosity size solution can be used, reducing water usage and the amount of energy needed to dry the sized yarns.

In the separating step, the sized yarns are passed over and under a series of lease rods, wherein an extensional acoustic wave is generated and propagates through each lease rod, producing shear deformation on the surface of the rod. The shearing motion effectively separates the yarns without breaking or weakening the strands.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

DETAILED DESCRIPTION OF THE INVENTION

The present invention relates to a method and apparatus for preparing warp yarns for weaving operations, and particularly to a slashing process which includes the steps of sizing and/or desizing the yarns in an acoustic resonance box and separating the yarns in a leasing apparatus comprised of a set of acoustically agitated lease rods.

Figure 1:
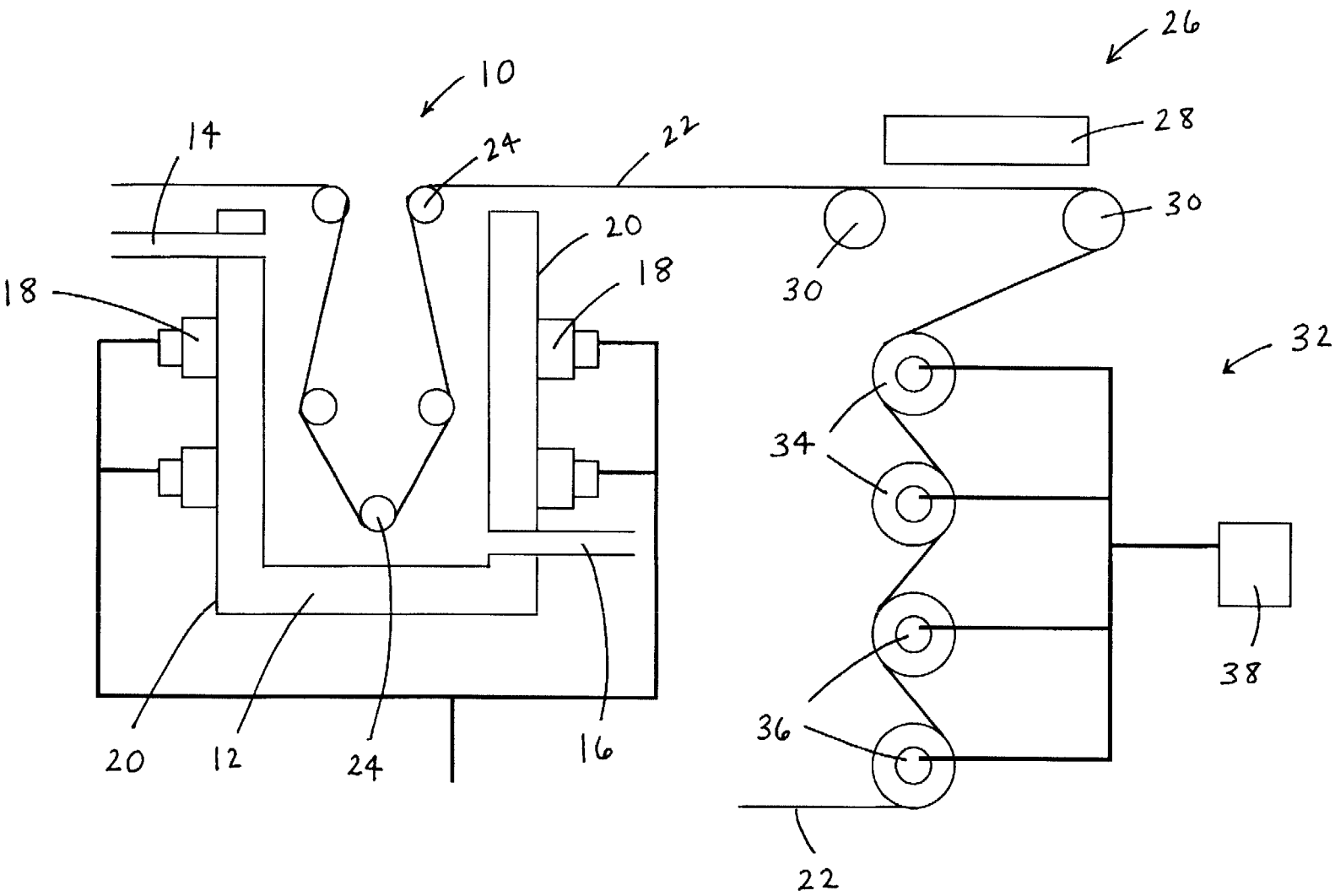
FIG. 1 is a plan view of the apparatus for sizing and separating yarns.

Referring now to the drawings, FIG. 1 is a plan view of the apparatus for sizing and separating the yarns. The system for sizing the yarns 10 comprises an acoustic resonance box 12 which contains the size solution. Size solution flows into and out of the acoustic resonance box 12 through flow channels 14 and 16, respectively. An acoustic field is generated in the size solution by positioning one or more acoustic transducers 18 against an exterior surface 20 of the acoustic resonance box 12. In the preferred embodiment, the acoustic transducers are microphones 18 which generate an acoustic pressure field within the size solution. The acoustic pressure field produces ultrasonic waves having a frequency greater than 20 Khz, which agitate the size solution, continuously mixing the size solution and allowing for a more uniform application, absorption, and penetration of the size solution onto and into the yarns 22. In addition, conventional rollers 24 are provided for guiding the warp yarns 22 through the size solution.

Importantly, by using an acoustic field, higher viscosity size solutions can be used, allowing for an increase in the concentration of size chemicals and a lowering of the concentration of water in the size solution. Thus, a reduction in water usage is achieved, and the energy required to dry the sized yarns will be conserved.

Next, the sized yarns are subjected to a conventional drying process 26. The yarns are passed under a microwave applicator 28 and over heated rollers 30, whereby a substantial amount of the water of the size solution on the yarns is evaporated.

The dried yarns are separated by the acoustic leasing system 32 which comprises a series of lease rods 34, wherein each lease rod 34 is connected to a transducer 36 which generates an acoustic wave that is propagated along the longitudinal axis of the lease rod. Conventional electroacoustic transducers 36, commonly made from a piezoelectric element, are used to convert electrical pulses to mechanical energy which in turn generate acoustic waves. The frequency of the acoustic wave is dependent upon the frequency of the applied electric potential and the characteristics of the piezoelectric element. In this preferred embodiment, a piezoelectric element 36 made of ceramic material is attached to one end of each lease rod 34. A pulser 38 applies an alternating electric potential across the piezoelectric element 36 causing the piezoelectric element 36 to vibrate. The vibration of the piezoelectric element 36 produces acoustic waves in the corresponding, attached lease rod 34.

Figure 2:
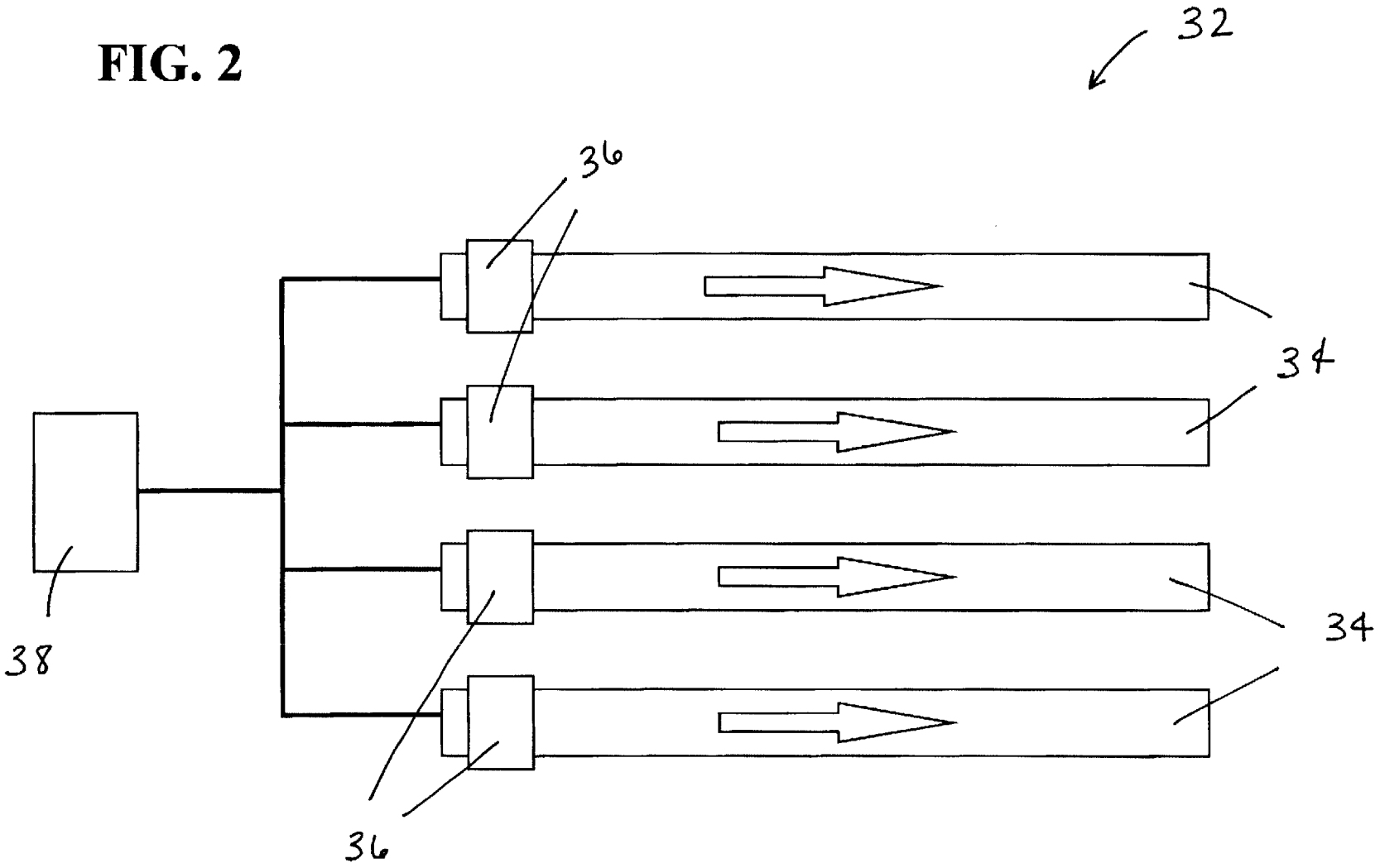
FIG. 2 is a plan view of the acoustic leasing system.

Importantly, the acoustic waves are extensional. The waves travel through the lease rod in a direction substantially parallel to the longitudinal axis of the lease rod 34, as shown in FIG. 2. The extensional waves create shear deformation on the surface of the lease rod 34. As the yarns 22 are guided over and/or under the lease rods 34, the yarns are subjected to the shearing motion and are thus caused to split and become detached from adjacent yarns.

It is understood that the acoustically vibrated lease rods may be used to separate the warp yarns prior to or after subjecting the yarns to a drying step, which may include but is not limited to passing the yarns under microwave applicators, through hot air, and/or over heated rollers or cans, whereby a substantial amount of the water is evaporated.

It is further understood that conventional controls may be used to monitor certain aspects of the slashing process, including the condition of the yarns, the pressure exerted by rollers, the temperature of the drying step, and the speed and the tension of the warp yarns.

The foregoing description of a preferred embodiment of the invention has been presented for purposes of illustration and description. It is not intended to be exhaustive or to limit the invention to the precise form disclosed, and obviously many modifications and variations are possible in light of the above teaching. The embodiments described explain the principles of the invention and practical applications and should enable others skilled in the art to utilize the invention in various embodiments and with various modifications as are suited to the particular use contemplated. While the invention has been described with reference to details of the illustrated embodiment, these details are not intended to limit the scope of the invention, rather the scope of the invention is to be defined by the claims appended hereto.

The embodiments of the invention in which an exclusive property or privilege is claimed are defined as follows:

1. A method for preparing warp yarns for a weaving operation comprising the steps of:

providing an acoustic resonance box containing a size solution;

positioning at least one first acoustic transducer against an exterior surface of the acoustic resonance box;

energizing the first acoustic transducer to generate an acoustic field in the size solution for continuously agitating the size solution;

immersing yarns in the size solution to apply the size solution to the yarns;

positioning a second acoustic transducer in contact with a lease rod;

energizing the second acoustic transducer to generate an extensional acoustic wave in the lease rod for producing shear deformation on the surface of the lease rod; and passing yarns over the lease rod, whereby adjacent yarns are separated.

2. The method as recited in claim 1 further comprising the step of altering the viscosity of the size solution to optimize application of the size solution to the yarns.

3. The method as recited in claim 1 further comprising the step of drying the sized yarns prior to separating the yarns.

4. The method as recited in claim 1 including using a microphone as the first acoustic transducer.

5. The method as recited in claim 1 including using a piezoelectric element as the second acoustic transducer.

6. An apparatus for preparing warp yarns for a weaving operation, comprising:

an acoustic resonance box for containing a size solution;

an array of acoustic transducers disposed against an exterior surface of the acoustic resonance box for generating an acoustic field in the size solution, whereby the size solution is continuously agitated for application onto and penetration into the yarns;

at least one lease rod; and a means for generating an extensional acoustic wave along the longitudinal axis of the lease rod, whereby shear deformation results on the surface of the lease rod for separating adjacent yarns.

7. The sizing and separating apparatus of claim 5 further comprising a means for drying the sized yarns.

8. The sizing and separating apparatus of claim 5 wherein the acoustic transducers are microphones.

9. The sizing and separating apparatus of claim 5 wherein the generating means comprises a piezoelectric transducer attached to an end of the lease rod and a pulser connected to the piezoelectric transducer.

* * * * *